United States Patent [19]

Kelly

[11] Patent Number: 4,879,701

[45] Date of Patent: Nov. 7, 1989

[54] MEMORIALIZED CASE CLOCKS

[75] Inventor: James H. Kelly, Pulaski, Va.

[73] Assignee: Pulaski Furniture Corporation, Pulaski, Va.

[21] Appl. No.: 240,201

[22] Filed: Sep. 6, 1988

[51] Int. Cl.[4] ..... G04B 15/00; G04C 21/00

[52] U.S. Cl. ..... 368/136; D10/16; 368/150; 368/179

[58] Field of Search ..... 368/134, 136, 150, 152, 368/165, 179, 285; D10/16

[56] References Cited

U.S. PATENT DOCUMENTS

| | | | |
|---|---|---|---|
| 328,142 | 10/1885 | Rhodes | 368/136 |
| 1,921,595 | 8/1933 | Vannini | 368/179 |
| 1,952,030 | 3/1934 | Korfhage | 368/150 |
| 4,123,898 | 11/1978 | Diels | 368/179 |

*Primary Examiner*—Vit W. Miska

*Attorney, Agent, or Firm*—William J. Daniel

[57] ABSTRACT

Case clocks, especially of the so-called tall-case or grandfather type, equipped with at least one suspended elongated weight, preferably contained within a weight shell or casing, are provided with at least one narrow annular memorializing band surrounding the weight or shell and retained thereon, the annular band carrying on an exposed surface indicia commemorating a particular event to be memorialized. Preferably, the memorializing band slidably encircles the weight or shell, the latter including at its lower end a radially projecting detent, of bead shape for example, to limit the downward movement of the band. A plurality of such bands can be stacked vertically end-to-end on each weight or shell. The weight and bands are visually exposed through doors or other openings or transparent panels in the clock case.

14 Claims, 1 Drawing Sheet

FIG. 1.
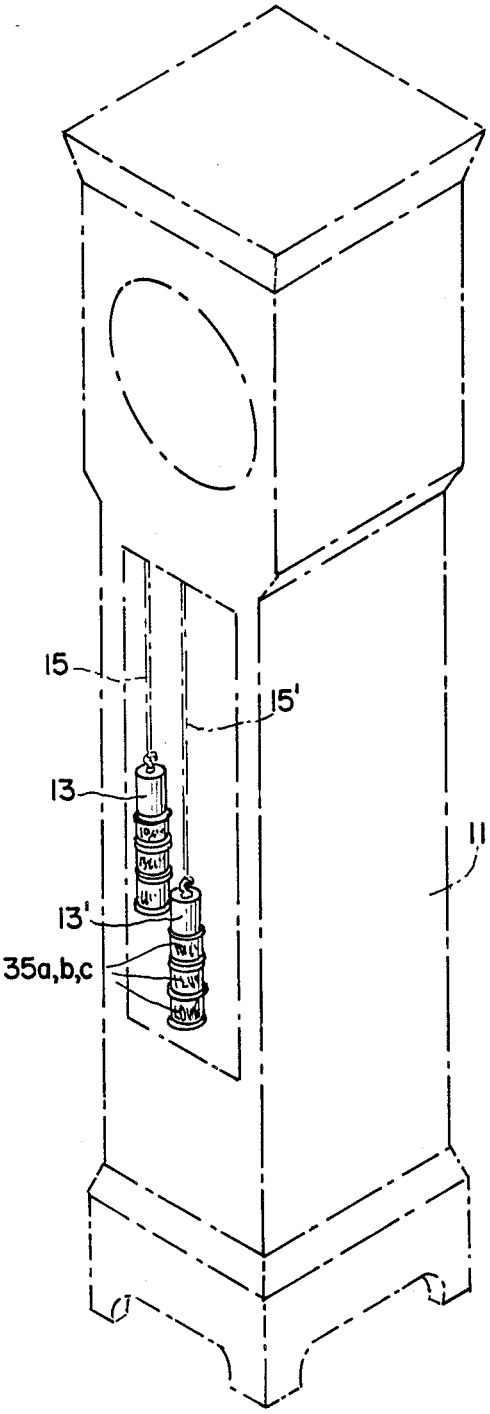
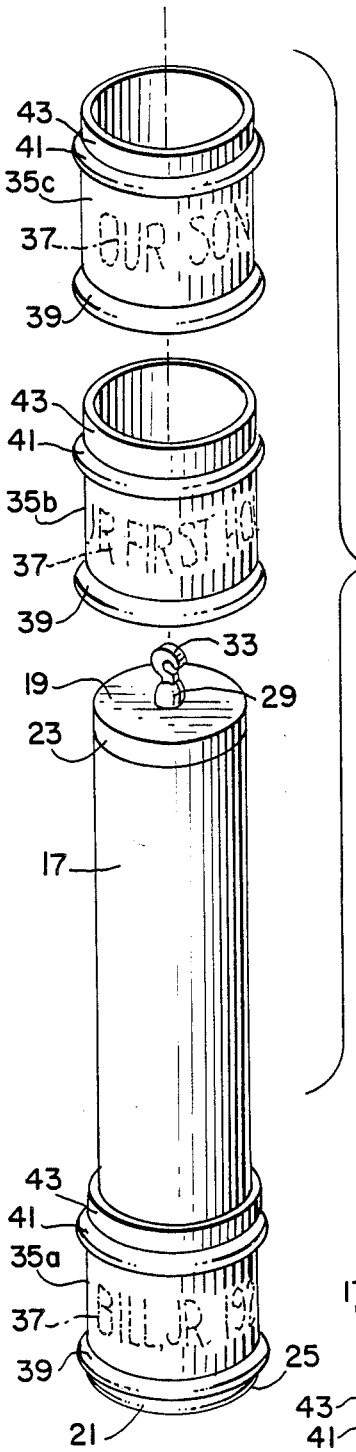
FIG. 2.
FIG. 3.
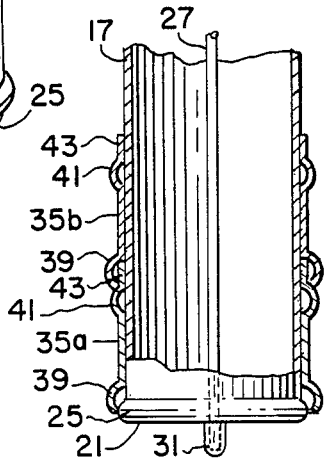

MEMORIALIZED CASE CLOCKS

FIELD OF THE INVENTION

This invention relates to clocks, especially case clocks; e.g., of the tall-case or grandfather-type which include one or more weights suspended within the case thereof, and is concerned more particularly with the memorialization of such clocks by means associated with such weights and carrying indicia commemorating a specific event, which means can be added to from time-to-time to commemorate additional events.

BACKGROUND OF THE INVENTION

Clocks have been driven by one or more weights since early times, such clocks usually having a case or cabinet for enclosing the weights and other mechanism not required to be displayed; e.g., the face and hands, for indicating time. As is known, these weights are suspended within the clock from one end of a flexible element, such as a chain or cord, the other end of which winds around the shaft of a gear of the like. The descent of the weight under gravity rotates the shaft and gear in one direction, such rotation being stepwise in increments controlled by a so-called escapement mechanism, which is in turn actuated; e.g., by a swinging pendulum. Such case clocks frequently embodied high levels of craftsmanship of both the clock maker and the cabinet maker and consequently became prized possessions of those fortunate enough to own them, typically being passed from one generation of a family to the next until some unhappy circumstances necessitated their disposal to a new owner with whom the process was repeated.

Clocks of this type often were provided with ornamental labels or plates identifying the clock maker or cabinet maker responsible for their construction and similar ornamental plates identifying an original or prominent owner thereof may well have been applied to their case in some instances. However, the number of such identifying plates that could be mounted on a given case without seriously detracting from the visual aesthetics of its design and finish were obviously limited so that little possibility existed for creating any continuing association between these clocks and their owners.

Similarly, it was known to apply engraving or other ornamental embellishment to the face of the clock pendulum and indicia relating to a particular owner or a possible event or experience associated with such clock could conceivably have appeared on the pendulum face of some clocks. Obviously, however, a pendulum has only two faces, thereby severely restricting the number of possible identifications that could be created in this fashion. No doubt, additional pendulums could be provided but, in any event, at any given time, only one face of one pendulum could be in visually exposed position within the clock, via the usual door or glass panels provided in the clock case.

"Family Bibles" have traditionally served to give a record of significant events or episodes occurring in the life of their owners, especially births, deaths, and the like. However, families following this tradition are becoming in creasingly rare and even when such a family record is maintained, such Bibles are usually stored in some secluded library shelf or closet and being consulted only infrequently at best, are of only limited assistance in bringing to the conscious understanding of its family members a continuing refreshed recollection or remembrance of important milestones in the history of that family which served to shape its identity and character.

Case clocks continue to be manufactured and sold in modern times and still, as a rule, exhibit fine quality work manship both in clock mechanism and finished case and therefore also tend to become treasured possessions of even present day purchasers. With only minimum care and attention, they last almost indefinitely and are transmitted from generation to generation with virtually the same respect as did their antique predecessors. The attachment or association that develops between clocks of this type and their owners would obviously be enhanced and strengthened if it were possible to adapt these clocks, without impairing their desirable ornamental quality, for the memorialization of special events or episodes experienced by an owner during his tenure and thereby provide, a record and reminder for consequent generations which could be augmented as time goes on to include similar significant occasions for each subsequent generation.

OBJECT OF THE INVENTION

The object of the invention is therefore a memorialized case clock which provides a visible record of significant events or occasions within the life of its owner which can be added to from time to time without detracting from its original beauty of the clock or interfering with its normal mode of operation.

A more specific object is the provision of a case clock including a weight suspended within its case and bearing at least one memorializing annular band provided with indicia commemorating a particular event or occasion to be perpetuated.

A further object is a case clock of the type in question in which each such memorializing annular band is disposed in slidable telescoping relation on the clock weight, which has detent means thereon for preventing the bottom such band from sliding off the weight, with additional bands optionally stacked end-to-end up the length of the weight.

BRIEF DESCRIPTION OF THE DRAWINGS

These and other objects of the invention will be more fully explained by the following detailed description of the invention when read in conjunction with the accompanying drawing in which:

FIG. 1 is a schematic perspective view of a tall case clock embodying the present invention, the clock case being shown in dotted outline to indicate the general context of the invention, the specific details of the clock design and construction being irrelevant;

FIG. 2 is an "exploded" perspective view of a conventional weight shell of the clock having a first ornamental memorializing annular band of the invention in operative position thereon, with additional bands shown in separated or "exploded" position, and FIG. 3 is a detail view taken partly in vertical cross section and partly in side elevation through the lower end section of the weight shell of FIG. 2, showing two of the ornamental annular memorializing bands in vertically stacked relationship on the weight shell.

DETAILED DESCRIPTION OF THE INVENTION

The present invention is applicable to any type of clock which includes at least one weight that when the clock is in use is in a visually exposed position such as by way of transparent panels, e.g., of glass or permanent openings formed in one or more walls of the clock case, or through one or more solid door panels which, while normally closed, are frequently opened for adjustment of the clock mechanism or elevation of the weights with consequential exposure of the weights to view. The door panels themselves can, and often do, include transparent panels, e.g.; "glass doors." It is known for some clocks to include weights which are housed inside wells or otherwise enclosed spaces within the casing and thus are never accessible to sight except when the casing is disassembled and clocks of the latter type are not suited for application of this invention which requires the presence of at least one weight for the clock which is in reasonably visually exposed position at least frequently if not continuously during the normal operation of the clock.

The clock weights ordinarily form part of the functional mechanism of the clocks, supplying under the biassing force of gravity, energy or power for driving the clock mechanism. However, it is not essential to this invention that the weights be operative or functional; they could rather be purely ornamental in character, being present as "dummy" weights simulating operative weights, the driving force for the clock mechanism being derived from another source such as a mainspring, an electrically driven motor or the like. The inventive concept is equally useful with non-functional weightsaas with operatively functional weights. Generally, clocks with associated weights of either type include an ornamental case, cabinet, or housing which can be constructed in any of a variety of known styles or designs. In principle, the clocks of the present invention do not require a case or housing as such. From the standpoint of effectiveness alone, the inventive concept is equally applicable to weights occupying a permanently exposed position, hanging suspended, for example, from the head of a clock (containing the operative mechanism and clock face) which is supported by a pedestal or the like above a supporting surface, such as a floor, shelf, or mantel, or even hung directly on a wall. However, since the great majority of clocks suitable for this invention do include ornamental cases, the invention is conveniently considered in this typical context.

The case clock of the present invention is entirely conventional in nature; consequently, the details of the clock mechanism as well as of the structure of the case or housing form no part of the present invention and need not be specifically described. In FIG. 1, the clock is shown only as a schematic or stylized outline in broken lines, as at 11, the clock mechanism or "works" including the face of the clock, its hands, pendulum, etc., being omitted for sake of clarity as well as convenience.

Case clocks, when actuated by gravity, require at least one suspended weight and if equipped with chiming mechanisms to strike at selected intervals, normally each quarter hour and the full hour, need at least two and more usually three such weights. For purposes of illustration, two such weights are shown in FIG. 1 with the designation 13, 13', each of which is suspended by a flexible chain or other flexible element 15, 15' shown in broken lines as a part of the con ventional clock structure. The actual weight bodies are ordinarily formed of relatively heavy metal such as cast iron or even lead; they therefore have a somewhat coarse exterior appearance and cannot easily be given an ornamenally attractive finish. Therefore, the actual weight bodies are usually enclosed within so called weight shells which are essentially ornamental rigid tubular containers for the weights constructed of sheet metal, such as brass, adapted to receive an attractive finish.

The details of construction of the weight shell can vary considerably and one common construction that is entirely suitable for the invention appears in FIGS. 2 and 3 to serve as an illustration. In this construction, the weight shell consists of a hollow tubular sleeve 17 having closures covering each of its top and bottom ends, when retained in the usual vertical position suspended from one of the chains 15, 15' As shown, the end closures can take the form of flat caps 19 and 21, each having a short skirt section projecting in overlapping relation with the adjacent end margins of sleeve 17. As illus trated, the top cap 19 carries a skirt 23 that is parallel to the sleeve wall while the bottom cap 21 has a skirt 25 that is arcuately curved or bowed outwardly in the form of a bead. Each of the end caps is penetrated by a small central opening, (not visible in the drawings) through which passes an elongated connecting rod seen in FIG. 3 at 27. The ends of rod 27 project a short distance exteriorly above and below the corresponding end caps and are threaded for engagement with interiorly threaded knobs 29 and 31. By threading the knobs toward one another, on the ends of rod 27, the end caps can be tightly retained within the sleeve ends to provide a rigid assembly for the weight shell. The actual weight body is omitted from FIG. 3 but would take the form of an elongated tubular mass of a diameter comfortably received within the interior of sleeve 17 and a hollow central bore permitting passage therethrough of the connecting rod 27. The uppermost knob 29 is preferably extended upwardly in the shape of a hook 33 for easy connection to a link or loop provided for that purpose at the end of the suspending elements 15, 15', as suggested in FIG. 1.

The exterior surface of the various components making up the weight shell will be finished in some attractive and ornamental manner. One common finish is a high polish which is especially appropriate when the sheet shell is constructed of brass sheet. However, other finishes could certainly be employed instead, including burnished or antiqued finishes, for instance; as may be desired, to match or complement the particular furniture style of the clock case. As an alternative to a brass- or gold-colored finish, a silver finish could be substituted, obtained with stainless steel or other suitable metal. If desired, use could even be made of sheet aluminum especially since the creation of very attractive and durable finishes on aluminum metal by means of anodization is now a well developed art; as was proposed in U.S. Pat. No. 4,123,898, issued Nov 7, 1978.

In accordance with the invention, one or more of the weight shells of the clock (or the weights directly if shells were not utilized) is employed to serve as the "carrier" or support for one or more ornamental annular memorializing bands of which three are shown at 35 a, b, & c. Each such memorializing band 35 is in the form of a tubular sleeve of a diameter slightly exceeding the outside diameter of the weight shell sleeve 17 so as to slide freely over the weight shell sleeve in reasonably close-fitting telescoping relation thereto. Each memorializing band is ornamentally finished, ordinarily in a style cr manner that is compatible with the finish of the weight shell and is adapted to carry on its exterior or outwardly exposed surface indicia, as at 37 a, b, & c, identifying in any appropriate way or meaning, a particular event, episode, or occurrence of significance, in the life of the owner of the clock. Such indicia is formed by applying, in an attractive way, such as by engraving or other type of embellishment, descriptive suitable words or pictures and dates or other information.

The memorializing band 35*a* at the lower end of the weight shell must be retained in position on the weight shell, i.e., kept from sliding off, when the latter is suspended in its normal vertical position, and detent means effective for this purpose is provided adjacent to the lower end of the weight shell. Such detent means can take any of a variety of forms As one example, the lower end cap 21 can conveniently serve this detent function by means of the outwardly bowed or beaded shape imparted to its skirt 25. This bead-shaped skirt protrudes beyond the radial limits of the shell sleeve 17 and thus can engage the lower end edge of the bottom memorializing band and prevent its displacement beyond the lower end of the weight shell. Alternately, the lower end cap, instead of having an outwardly extending bead-shaped skirt could simply have a radial lip or shoulder with a radial dimension exceeding the inside diameter of the memorializing band. As another alternative, the lower margin of the weight shell sleeve itself could be deformed into one or more radially directed projections acting as a stop for the lower edge of the memorializing band. Yieldable stop means could even be built into the weight shell end.

The axial length of each band can be selected as desired according to the number of bands to be accommodated by each weight shell. For instance, each band could have a length equal to about ⅛or 1/6 of the shell length so that each shell would have an ultimate capacity for carrying 6 or 8 such bands in vertically stacked position. When two or more bands are so stacked on the same shell, the bottom band supports the lower edge of the next higher band and so on. The ornamental configuration of the bands can vay widely. They could take the form of simple tubular sleeves but perferably include features imparting a more ornamental or stylized appearance thereto. As one appealing example, the lower margin of each memorializing band can be shaped with an exterior-bow or bead 39 generally similar to that of the lower end cap 21 with an axially spaced matching bead or bow 41 present adjacent the opposite upper end margin thereof. Thus, these two vertically separated ornamental beads define between them a peripheral "field" suitable for inscription with the commemorating indicia.

It is preferred that the upper end of each memorialized band 35 be extended vertically as at 43, parallel to the shell sleeve wall to define an annular axial rim which can fit in overlapping telescoping relation with the loWer beaded margin of the next higher memorializing band, the interior diameter of the latter being slightly expanded to accept the underlying extension rim there-beneath. In this manner, a plurality of the memorializing bands can be stacked in one substantially continuous vertical array.

With the weight shells being suspended from their upper ends, it is not necessary to provide means for inhibiting the upward travel of the memorialized bands 35 relative to the weight shell as a whole, and in this case, the maximum diameter of the upper end cap 19 of the weight shell will be dimensioned to allow the sliding passage there-over of the bands 35. The latter are biased by gravity toward the bottom end of the shell and would be prevented in any case from being separated or removed from the weight shells by the chain or other suspending element 15. Indeed, the provision of an upper or top end cap 19 which is smaller than the inside diameter of the memorializing bands has the advantage of facilitating the addition of future memorializing bands without disassembly of the weight shell However, a similar form of detent means could certainly be provided at the upper end of each weight shell as well as at the lower end thereof. In this way, a weight shell carrying a full complement of memorializing bands would be maintained as an integral unit which could be handled and stored, if need be, without fear of loss of any of the memorializing bands.

Examples of acts, events, episodes or the like of sufficient significance or meaning to a given owner or family are almost limitless and would easily come to mind. The birth of a new family member or the death of an existing family member would be typical illustrations, as might be the purchase of a new home, a graduation, a marriage, and so on. Indeed, the scope of events to be memorialized by the concept of the invention is as broad as one's imagination.

The disclosure of features of the invention by reference to specific embodiments is not intended to limit the scope of the invention unless required by the language of the appended claims.

What is claimed is:

1. In a case clock including a hanging generally elongated weight, an improvement for memorializing the same which comprises an ornamental annular band surrounding said weight over at least a portion of its length and supported thereby, said band carrying on an exterior surface thereof indicia commemorating an event to be memorialized.

2. The clock of claim 1 including cooperating detent means on said band and weight for retaining said band in place on said weight.

3. The clock of claim 2 wherein said band is slideably arranged on said weight and said cooperating detent means limits downward relative moveeent of said band with respect to said weight to the end of said weight while per mitting upward relative movement thereof.

4. The clock of claim 1 wherein said weight comprises a weight body and a tubular shell enclosing said weight body and said annular band encircles said weight shell.

5. The clock of claim 4 wherein said weight shell comprises a tubular sleeve fitting around said weight body, closures for each of the open ends of said sleeve, at least one of which is removable, and connecting means for holding the end closures and sleeve together, said annular band encircling said sleeve in closely fitting sliding telescoping relation, and the end closure at the lower end of said sleeve includes a projection extending radially beyond the sleeve diameter for engaging the lower edge of such band when positioned adjacent the lower shell end to prevent the band from sliding downwardly past said lower end closure.

6. The clock of claim 5 wherein said projection on said lower end closure is an exterior bead.

7. The clock of claim 1 wherein the case of said clock includes a door in the front face, thereof and said weight hangs within said case in a position that is generally visually exposed when said door is open.

8. The clock of claim 1 wherein the case of said clock includes at least one transparent panel therein and said weight hangs in said case in a position that is generally visually exposed through said transparent panel.

9. A memorialized weight shell for a case clock comprising a hollow tubular shell adapted to contain a weight body, end closure walls at the ends of said shell, at least one of said closure walls being removable, means at one end of said shell for suspending said shell in said clock, at least one ornamental annular band fitting in closely spaced sliding telescoping relation over a portion of the length of said shell, and detent means for preventing sliding movement of said annular band past the end of said shell opposite said suspending means when said weight shell is supported thereby, said annular band carrying on an exposed surface thereof indicia commemorating an event to be memorialized.

10. The weight shell of claim 9 wherein said wall at the end of said shell closure opposite said suspending means includes a radially projecting lip constituting said detent means.

11. The weight shell of claim 10 wherein said lip is in the form of a bead.

12. The weight shell of claim 9 wherein at least two of said ornamental bands are arranged in vertically stacked relation on said tubular shell, each said band including a slightly flaring margin at its lower end and a short cylindrical extension at its upper end, the extension of one said band fitting within the flaring margin of the next higher band and overlapping therewith when said bands are in said stacked relation.

13. The weight shell of claim 12 wherein said slightly flaring margin of each such band is formed as a radially protruding bead.

14. The weight shell of claim 13 wherein said memorializing band includes a radially protruding bead adjacent its upper end below said cylindrical extension.

* * * * *